US006308642B1

(12) United States Patent
Branam et al.

(10) Patent No.: US 6,308,642 B1
(45) Date of Patent: Oct. 30, 2001

(54) PALLET ASSEMBLY

(76) Inventors: Jeannette Branam, 4310 NW. 128 Street Rd.; Joe Harry Branam, 4730 NW. 128 Street Rd., both of Miami, FL (US) 33054

( * ) Notice: Subject to any disclaimer, the term of this patent is extended or adjusted under 35 U.S.C. 154(b) by 0 days.

(21) Appl. No.: 09/415,145

(22) Filed: Oct. 8, 1999

(51) Int. Cl.[7] ..... B65D 19/44

(52) U.S. Cl. ..... 108/55.1; 248/346.02; 403/231; 108/55.5

(58) Field of Search ..... 108/51.11, 55.1, 108/55.3, 55.5, 55.2; 206/386, 600; 248/346.02, 346.03, 346.07, 499; 40/782, 783; 403/231

(56) References Cited

U.S. PATENT DOCUMENTS

| | | | | |
|---|---|---|---|---|
| 3,428,002 | * | 2/1969 | McIntire et al. | 248/346.02 X |
| 3,452,958 | * | 7/1969 | Hambleton | 108/55.5 |
| 3,509,832 | * | 5/1970 | Daisley, Jr. | 108/55.1 X |
| 3,591,121 | * | 7/1971 | Parris | 248/346.02 X |
| 3,622,114 | * | 11/1971 | McIntire, Jr. | 108/55.5 X |
| 4,205,486 | * | 6/1980 | Guarnacci | 403/231 X |
| 5,284,098 | * | 2/1994 | Klapperich et al. | 108/55.5 |

* cited by examiner

*Primary Examiner*—Peter M. Cuomo
*Assistant Examiner*—Michael J. Fisher
(74) *Attorney, Agent, or Firm*—Malloy & Malloy, P.A.

(57) ABSTRACT

An aircraft pallet assembly structured to support and retain cargo intended to be loaded on and transported by commercial aircraft, wherein the pallet assembly comprises a base and a surrounding peripheral portion normally including a multi-sided configuration. Each side of the base includes a peripheral flange extending at least along a majority of the length thereof, which is disposed and configured for fixed attachment to one of a plurality of track segments, collectively defining a track assembly, and structured to removably secure a load retaining assembly, typically in the form of a retaining cover or net in overlying, covering relation to the cargo, for purposes of maintaining the cargo in an intended position on the base of the pallet assembly. A plurality of corner assemblies are interconnected to the base through attachment to adjacently positioned ones of the track segments, wherein attachment of the track segments to correspondingly positioned peripheral flanges is accomplish by at least partial insertion of the peripheral flange into the respective track segment, thereby eliminating the utilization of a plurality of conventional fastener elements, such as rivets, screws, bolts, etc. to accomplish the attachment of the track assembly to the peripheral portion of the base.

5 Claims, 4 Drawing Sheets

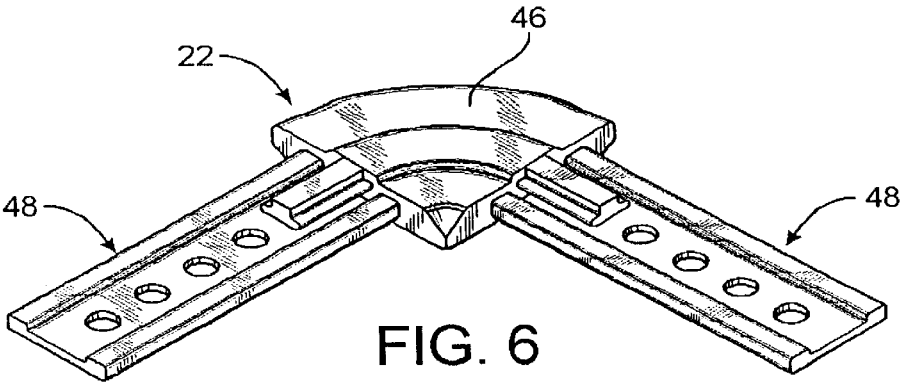
FIG. 6
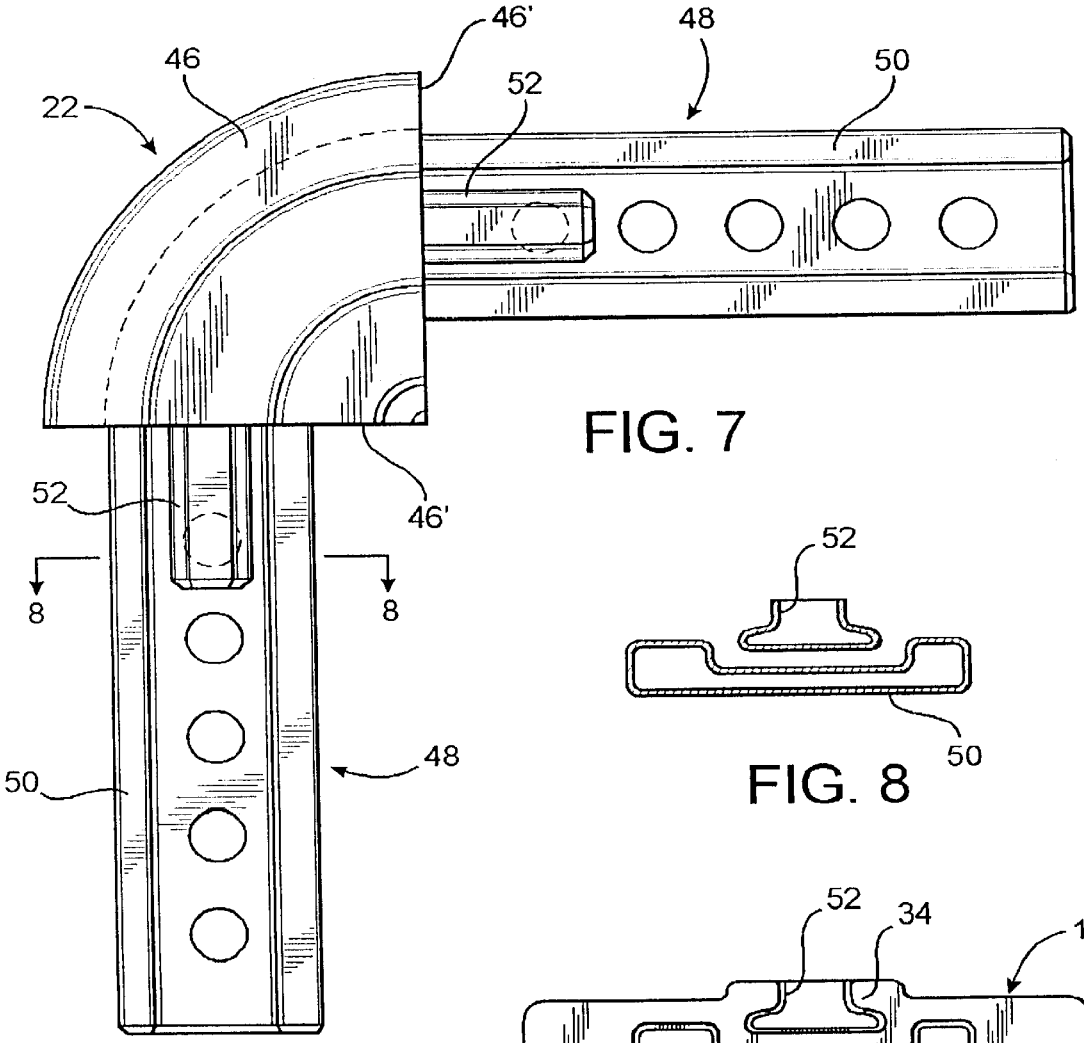
FIG. 7
FIG. 8
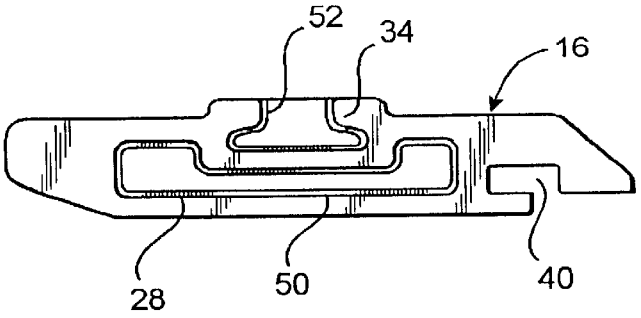
FIG. 9

PALLET ASSEMBLY

BACKGROUND OF THE INVENTION

1. Field of the Invention

The present invention is directed towards a pallet assembly primarily but not exclusively designed to retain and support cargo within the interior of commercial aircraft and including a track assembly designed to removably secure a retaining cover or like retaining assembly to the pallet, wherein the retaining assembly is of the type typically used in maintaining cargo on a pallet during transport thereof. The track assembly is secured to a base and is cooperatively structured therewith to define a gripping attachment therebetween, which eliminates the need of conventional fasteners, such as rivets or the like, commonly used in the pallet manufacturing industry, thereby increasing the safety and stability of the pallet, and minimizing pallet down time due to fastener repair requirements of the Federal Aviation Administration (FAA).

2. Description of the Related Art

During recent years, there has been a significantly large increase in the amount of freight or cargo transported by commercial airlines. While it has long been common practice to include the transport of freight on airlines, which are primarily directed to passenger service, there has been a significant increase, in the airline industry, of companies dedicated entirely to the transport of freight as versus passengers. A major contributing factor to this increase in the transport of air freight is the proliferation of air freight services which are directed to the express delivery of packages of all sizes, throughout the United States and overseas. Such express delivery services are offered not only by the U.S. Postal Service but by private companies. All of the larger b delivery companies, of the type set forth above and of standard commercial cargo, maintain an entire fleet of commercial aircraft, wherein the individual airplanes have their interior configurations structurally modified to facilitate carrying the maximum freight or cargo load possible.

The loading of air freight within the cargo compartment of an aircraft typically involves the use of pallets, available in a variety of different sizes, which are disposed in the aircraft and are otherwise designed to support and retain cargo thereon. A primary benefit to the use of such pallets is the ability to load a large volume of smaller items at one time, after they have been pre-loaded on the pallet at a remote location. Moreover, the pallet functions to maintain the items securely and uniformly retained on the aircraft. In particular, the supported load is typically maintained in its intended position on the pallet by means of some type of retaining cover or structure, specifically designed to allow the maximum load to be placed on each pallet, while at the same time assuring that the loaded cargo will not shift or be inadvertently displaced from the pallet during take-offs, landings or during the actual in-flight maneuvers of the aircraft.

It is of course widely known that the "balancing" of any load carried by aircraft, whether the load is comprised of a plurality of passengers, freight or a combination of both, is of primary importance for the safe and efficient operation of the aircraft. Any inadvertent shifting of the load or other significant re-distribution of weight within the aircraft, during flight, such as would be the result of inadvertent displacement of cargo or freight from its supported position on a pallet, could result in dangerous, unsafe flight conditions and threaten the safety of the aircraft, as well as the life of the flight personnel and/or passengers.

In order to avoid any inadvertent displacement of air cargo or freight, of the type set forth above, the aforementioned retainer structures or covers overlying the freight are removably but securely connected to the pallet base, in a manner which would normally prevent such displacement. Pallet structures of known or conventional design typically include a track, extending along at least a portion of the periphery thereof, which is specifically structured to securely fasten the retaining covers in their intended, overlying position, relative to the load or freight mounted on the pallet base. Due to the importance of eliminating any possibility of weight shift due to inadvertent displacement of freight or cargo within the interior of an aircraft, regulatory agencies, such as the FAA, regularly and thoroughly examine the structural integrity of the pallet structures used to support and retain freight loads within an aircraft, as set forth above. One problem consistently found during such examinations is the failure of a significant number of pallet assemblies because the aforementioned retaining tracks have a tendency to become at least partially separated from the base of the pallet. Conventional or known pallet design and construction normally involves the use of closely spaced rivets or other applicable fasteners extending along the length of the track assembly and serving to securely anchor the track assembly to the base of the pallet. The aforementioned regular inspections all too often determine that the rivets become loosened or displaced, because of the tremendous stress or force placed thereon by the attached retaining covers, during normal flight conditions. Moreover, the requirements of the regulatory agencies are so strict, that even if only a small number of fasteners fail, the entire pallet must be made inactive until repaired.

Therefore, there is a recognized need for a significant improvement in the design and structure of a pallet assembly designed to support and retain heavy loads of freight or cargo in a stable manner on the interior of aircraft or other vehicles. Such an improved pallet assembly should be structured to eliminate, as much as possible, the inadvertent and/or partial detachment of a track assembly from the base of the pallet, preferably by eliminating the use of a plurality of rivets, or like fasteners, that are independently susceptible to failure, to fixedly attach the assembly to the base. In addition, such an improved pallet assembly should be designed to facilitate the assembly and manufacture of the various components associated with the pallet assembly, in a manner which will prevent separation or partial detachment of the track assembly from the base of the pallet, and which increases the security and stability of the pallet within the FAA requirements.

SUMMARY OF THE INVENTION

The present invention is directed towards a pallet assembly of the type primarily, but not exclusively, designed to support and retain various loads within the interior of a commercial aircraft. Moreover, the pallet assembly maintains those loads in a manner which facilitates the removable but secure attachment of a load retaining cover or like structure in overlying relation to the freight mounted on the base of the pallet.

The load retaining structure may include a variety of different known or conventional designs, and is in and of itself not an intended part of the present invention. However, the purpose of securing the load retaining structure to the pallet assembly, regardless of the structural design thereof, is of prime importance in preventing the shifting and/or displacement of the load, supported on the pallet, within the aircraft, or other vehicle, during flight or travel.

More specifically, the pallet assembly of the present invention comprises a base formed preferably, but not necessarily, of a solid sheet of high strength, light weight All material, such as but not necessarily limited to metal. Furthermore, the base includes a peripheral portion disposed in surrounding relation to the centrally disposed base, wherein the peripheral portion preferably, but not necessarily, comprises a multi-sided configuration. Furthermore, the peripheral portion preferably comprise a plurality of peripheral flanges, each having an elongated configuration and extending along the length of the various sides of the peripheral portion. Each of the peripheral flanges comprises a predetermined dimension and cross-sectional configuration, which is cooperatively structured with a track assembly for attachment therewith, as will be explained in greater detail hereinafter.

The track assembly preferably extends about the peripheral portion of the base and is structured to removably receive and fixedly secure any of a variety of different load retaining structures in covering, protective relation to the load mounted on the base of the pallet assembly.

Each of the peripheral flanges terminates at oppositely disposed ends, substantially corresponding to the ends of the sides of the base on which they are mounted. Accordingly, correspondingly positioned ends of adjacent peripheral flanges are disposed in spaced relation to one another, in the vicinity of the corresponding corner of the base. In order to avoid such corner spaces and provide a substantially continuous periphery extending about the base, the pallet assembly of the present invention also comprises a plurality of corner assemblies. Each corner assembly is disposed in aligned relation to a different one of the plurality of corners of the base and is interconnected to the base through direct attachment to correspondingly positioned portions of the track assembly, as also will be described in greater detail hereinafter.

The aforementioned track assembly preferably comprises a plurality of integral and/or segmented track segments, preferably equal in number to the plurality of peripheral flanges secured to the base and also preferably being substantially equal in length to the respective ones of the peripheral flanges to which they are attached. Each of the track segments, may also be formed of a light weight, high strength, metallic or other applicable material.

As set forth above, each of the track segments are cooperatively structured to be fixedly and securely mounted on respective ones of the peripheral flanges, in a manner which will eliminate the necessity of utilizing a plurality of conventional fastener or connector members, such as rivets, screws, bolts or the like, that are typically employed with conventional or known pallet assemblies of the type designed to support and retain air cargo or freight. More specifically, each of the track segments preferably includes a securement assembly, such as a track, defined at least along a majority of the length of said track segment and preferably along the entire length thereof. Each track is preferably defined in communicating relation with an outer exposed surface or face of the track segment and is specifically structured to removably receive and securely retain cooperatively structured coupling elements mounted and/or associated with the aforementioned load retaining structures.

In addition, each of the track segments preferably includes an elongated slot formed at least partially on the interior thereof, and including an opening extending along a length thereof. The elongated slot is cooperatively structured with each of the peripheral flanges, such that the peripheral flange may be inserted into the slot at least partially on the interior of the track segment. A portion of the peripheral flange is allowed to pass through the aforementioned opening so as to not interfere with the integral or otherwise fixed junction between the peripheral flange and the base. Accordingly, it should be apparent that the cross-sectional configuration of the each of the peripheral flanges may substantially correspond to the cross-sectional configuration of each of the elongated slots. By virtue of these corresponding configurations, at least a portion of the peripheral flange can be inserted within and fixedly retained by a corresponding track segment so as to define a gripping attachment therebetween. More specifically, a corresponding one of the peripheral flanges is at least partially surrounded or enclosed within an elongated slot of the track segment.

As set forth above, each of the aforementioned corner assemblies are interconnected to the base by means of their attachment to adjacently positioned ones of the plurality of track segments. Accordingly, each of the corner assemblies includes a corner segment disposed in aligned relation to a corresponding corner of the base, and two connector assemblies, each extending outwardly from spaced apart portions of the corner segment into aligned relation with the adjacently positioned track segments. In order to accommodate attachment of the corner assemblies to the corresponding track segments, again without the need for the utilization of conventional fasteners or connectors, such as rivets or the like, the connector assemblies associated with each corner assembly are preferably received within open ended channels, which at least partially define a hollow interior portion of the respective track segments. Moreover, those open ended channels are preferably communicatively and/or integrally defined with the elongated slot wherein the peripheral flange is disposed.

It is also emphasized that while the predetermined cross-section of each of the peripheral flanges may be defined by a general L-shape configuration, the cross-sectional configuration of each of the peripheral flanges, as well as the elongated slot integrally formed in the track segments, may vary from such an L-shape, while still defining a secure, gripping attachment between corresponding ones of the peripheral flanges and track segments.

These and other features of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 6 is a perspective view of a corner assembly associated with the embodiment of FIG. 1, shown in schematic form;

FIG. 7 is a top view of the structure of FIG. 6;

FIG. 8 is a sectional view along line 8—8 of FIG. 7;

FIG. 9 is a end view in partial section of a track segment coupled to said corner assembly.

Like reference numerals refer to like parts throughout the several views of the drawings.

DETAILED DESCRIPTION OF THE PREFERRED EMBODIMENT

As shown in the accompanying Figures, the present invention is directed towards a pallet assembly, generally indicated as 10. The pallet assembly 10 is of the type that is capable of supporting and retaining a load, in the form of freight, cargo, etc., and more particularly, is preferably configured to be securely disposed within the interior cargo compartment of an aircraft.

Figure 2:
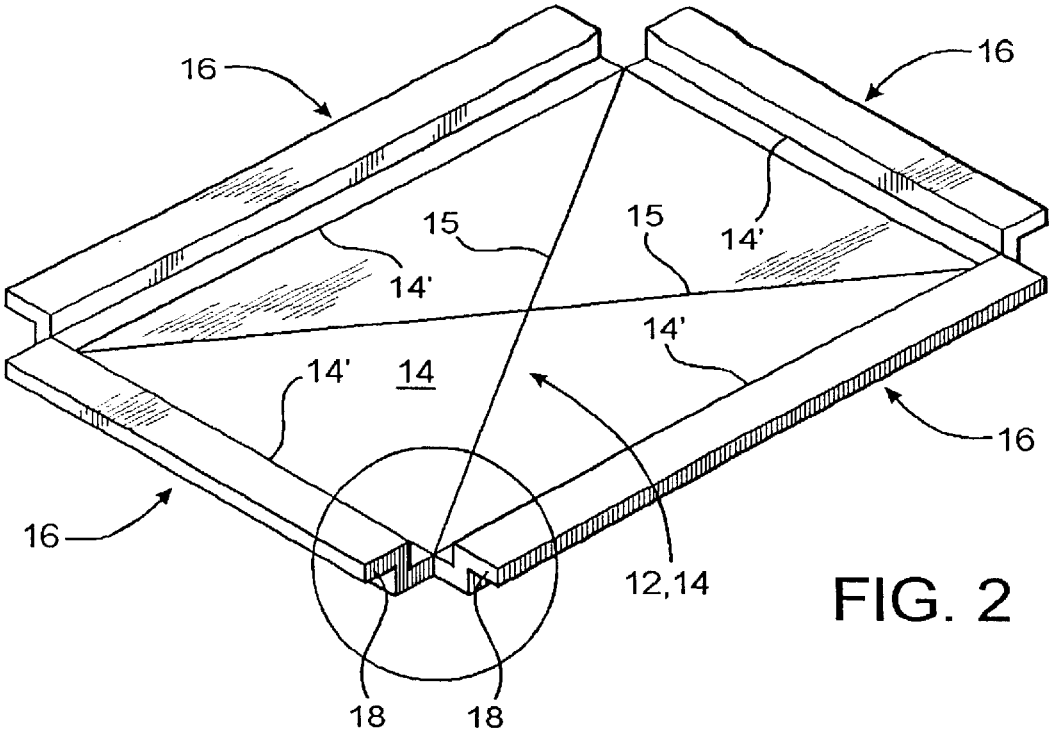
FIG. 2 is a perspective view of a base of the pallet assembly of the embodiment of FIG. 1 shown in schematic form.
Figure 3:
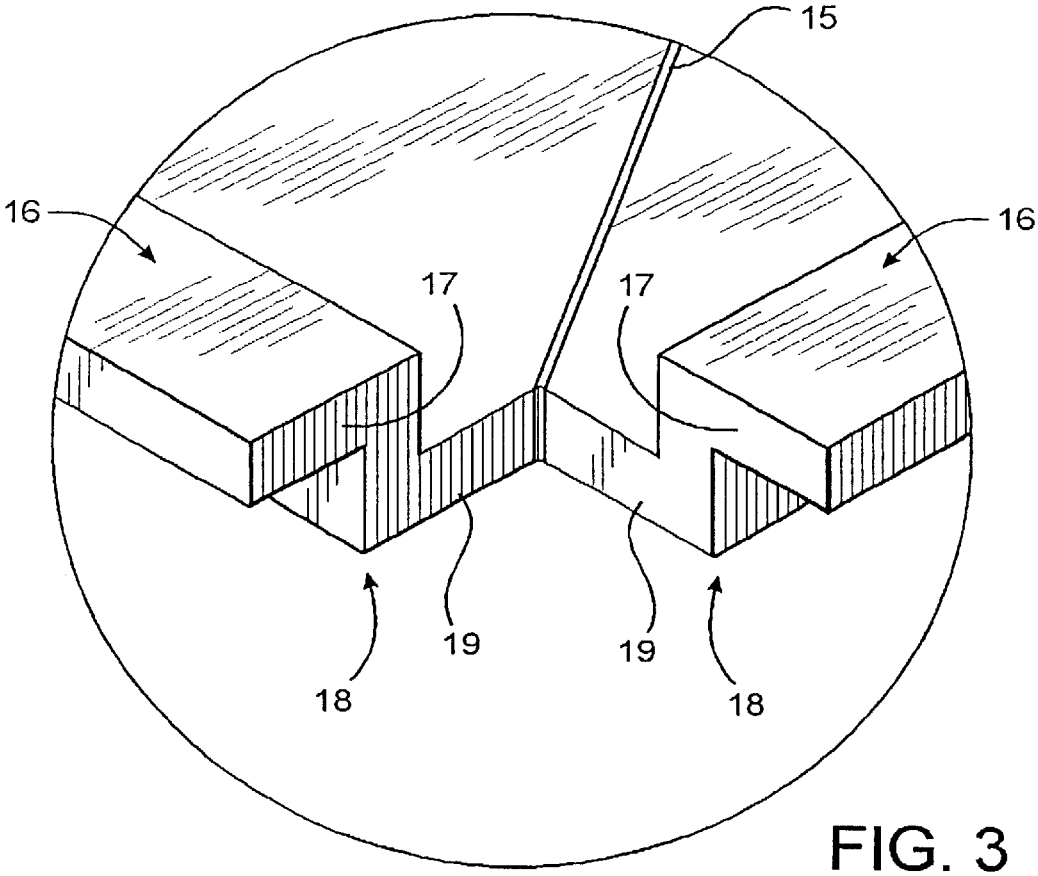
FIG. 3 is a perspective, isolated view in partial cutaway showing details of the corner of the base illustrated in FIG. 2.

More specifically, the pallet assembly 10 comprises a base, generally indicated as 12. The base 12 preferably, but not necessarily, includes a central portion 14 formed from solid, one piece construction, and preferably of a metallic sheet material. Additionally, the peripheral portion of the base 12 comprises at least one but preferably a plurality of peripheral flanges, generally indicated as 16, disposed in spaced apart relation from one another about the peripheral portion of the base 12. Each of the peripheral flanges preferably includes an elongated configuration, and extends along the length of respective ones of a plurality of sides of the base 12, which normally, but not necessarily comprises, a multi-sided ill configuration. Furthermore, although each of the peripheral flanges 16 may be of unitary or segmented construction, the overall length of each peripheral flanges 16 is preferably substantially equivalent to the length of the side of the central portion 14 of the base 12 along which it extends. Accordingly, each of the peripheral flanges 16 preferably terminates in oppositely disposed ends 18, and because the length of each of the peripheral flanges 16 is substantially equivalent to the respective sides to which it is attached, there is a spacing between correspondingly positioned ends 18 of adjacently positioned peripheral flanges 16 as best shown in FIGS. 2 and 3. The space between the correspondingly positioned ends 18 is disposed in aligned relation with a corner 20 of the base 12, and in some cases may be greater if a shorter peripheral flange structure is desired.

As will be explained in greater detail hereinafter, the open space disposed in aligned relation with the base corner 20 is filled by a corner assembly, generally indicated as 22, and shown in detailed in FIGS. 6 through 9. Further, as also best shown in FIGS. 2 and 3, each of the peripheral flanges 16 are preferably integrally or otherwise fixedly secured to respective ones of the sides 14' of the central portion 14 of base 12 in order to assure the structural integrity of the pallet assembly 10 without the need for fasteners, as well as a secure mounting or interconnection of the remaining components of the pallet assembly 10. Additionally, in order to further add to the strength and/or structural integrity of the base 12 and particularly the central portion 14 of base 12, one or more seams or breaks 15 may be integrally formed in the central portion 14, and, depending upon the overall configuration of the base 12, may, for example, be in the form of a cross break.

A further structural feature of the present invention is the provision of a track assembly, generally indicated as 24, securely attached to the base 12, generally about the peripheral portions thereof. In particular, the track assembly 24 is secured, in at least partially surrounding relation to the central portion 14 of the base 12, in a substantially fixed manner which eliminates the need for the utilization of conventional fasteners or connectors, such as but not limited to rivets, typically used in known or conventional pallet structures. Of course, if desired, additional fasteners could be added for increased strength.

Figure 1:
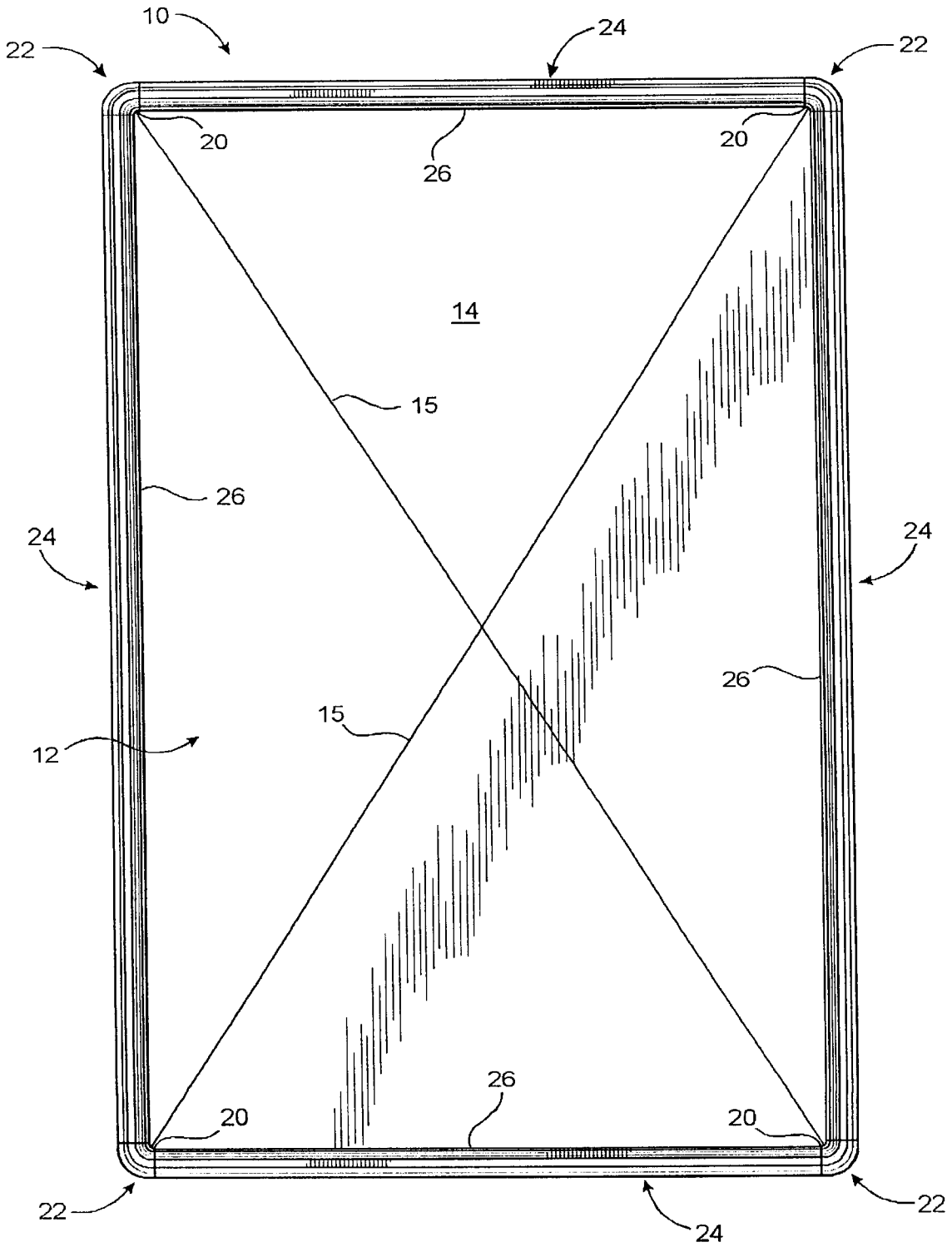
FIG. 1 is a top plan view of an assembled pallet assembly of the present invention.
Figure 4:
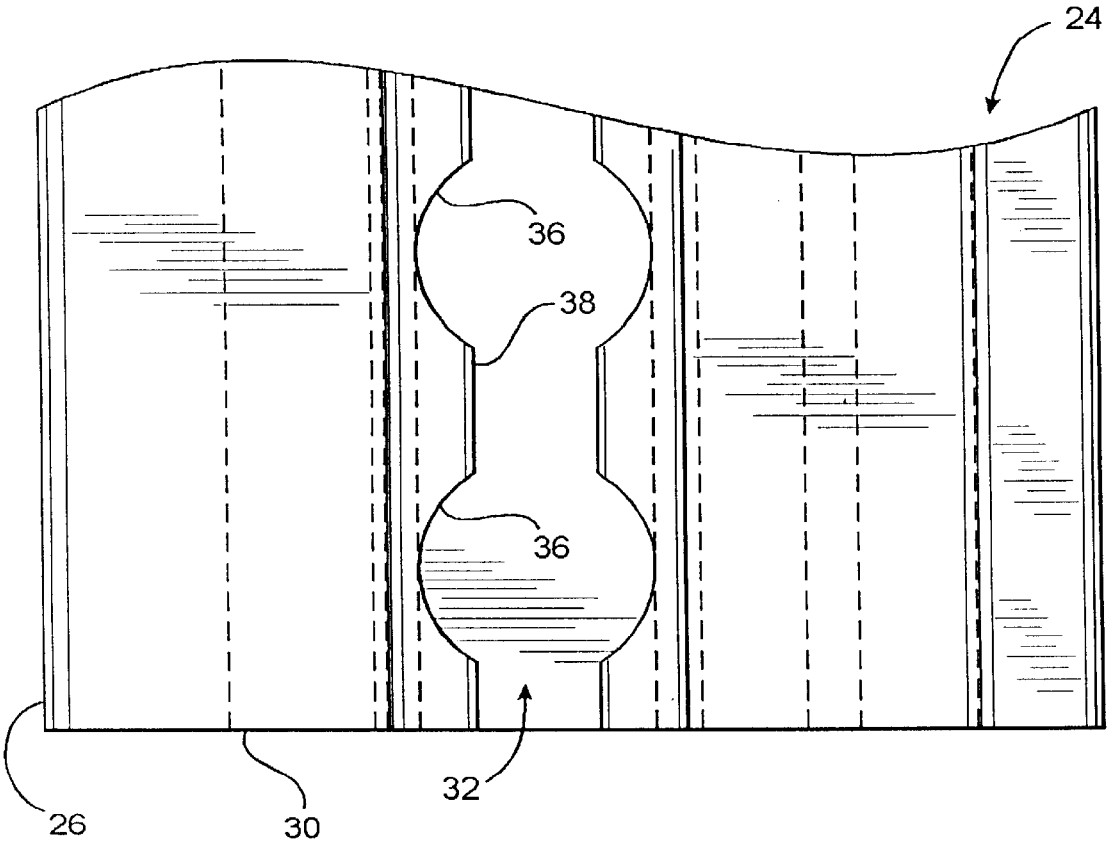
FIG. 4 is a top plan view in partial cutaway of a track segment associated with the embodiment of FIG. 1.
Figure 5:
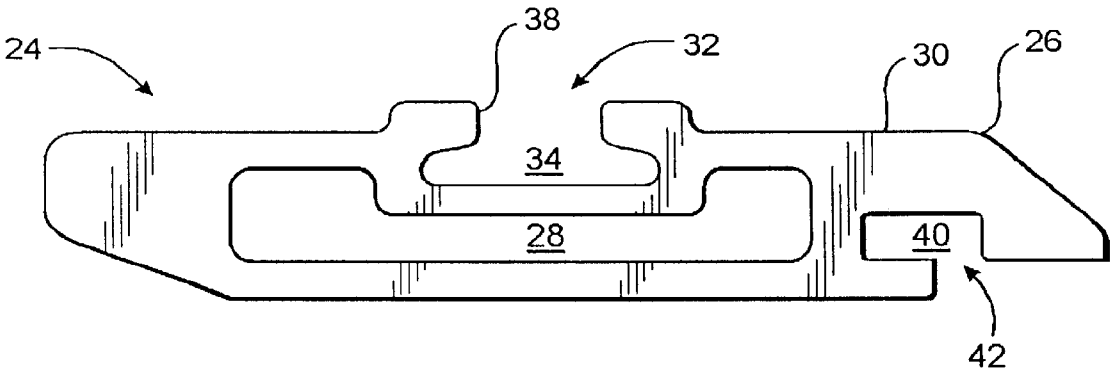
FIG. 5 is an end view of the structure of FIG. 4.

More specifically, the track assembly 24 comprises at least one, but preferably a plurality of track segments 26 shown in mounted or assembled form on the pallet assembly 10 in FIG. 1 and shown in detail in FIGS. 4 and 5. Each of the one or more track segments 26 comprises an elongated configuration, preferably corresponding in length to the peripheral flange 16 to which it is attached, and much like the peripheral flanges 16, may be of integral or segmented construction. Further, each of the track segments 26 preferably comprises an at least partially hollow interior portion. In particular, in the illustrated embodiment, each track segment 26 preferably includes a centrally disposed channel 28. The channel 28 may extend partially or completely along a length of the track segment 26, but preferably includes an open end which corresponds to and extends through the end 30 of the respective track segments 26. As a result of this channel 28, an overall weight of the track segments 26 is reduced. In addition to the channel 28, the aforementioned hollow interior portion of the individual track segments 26 may also be defined by a track, generally indicated as 32. The track 32, which is preferably, but not necessarily a single continuous structure, includes a track interior 34 which communicates directly with a plurality of spaced apart apertures 36, as best shown in FIG. 4. Each of the apertures 36 are separated by a narrowed portion 38 having a lesser transverse dimension than the diameter or equivalent transverse dimension of the plurality of apertures 36. The track 32 is structured, dimensioned and configured to accommodate the removable but fixed retention of a connector or other structure secured to and/or associated with a load retaining structure, such as a net, (not shown for purposes of clarity) which, as set forth above, is maintained in a covering, retaining relation to any load supported on the base 12 in the conventional fashion. As can be appreciated, the apertures 36 and/or other structure at which the load retaining structure is secured may include a variety of different configurations, and may be defined only at fixed securement points rather than as a continuous elongate structure. Still, however, the track interior 34 which defines each portion or all of the track 32 fastening points also preferably extends through the end 30 of the track segment 26, as in FIG. 5.

The track segments 26 of the present invention also include an elongated slot 40 defined therein and preferably extending along a length of each of the track segments 26. The overall length of the slot 40, which may be continuous or segmented, is preferably at least generally equal to the length of the individual peripheral flange 16 which is attached thereto, as explained hereinafter. The slot 40 also includes an opening, as at 42, which also preferably extends along the entire length of the slot 40.

With reference to both FIGS. 3 and 5, the peripheral flanges 16 have a predetermined cross-sectional configuration which fits into and preferably corresponds to the cross-sectional configuration of the slot 40. In the embodiment of FIG. 3, such cross-sectional configuration is defined by an outer flange segment 17 extending laterally outward from the central portion 14 of base 12, as well as an inner flange segment 19, which integrally or otherwise fixedly connects the peripheral flange 16 to the respective sides 14' of the base 12. While the specific cross-sectional configuration of each of the peripheral flanges 16 may vary, one preferred cross-sectional configuration is substantially an "L-shape" so as to define an overall "Z" configuration with the central portion 14 of the base 12. Similarly, the cross-sectional configuration of the elongated slot 40 also has what may be considered a corresponding cross-sectional configuration by virtue of the relative position of the slot 40 and its associated opening 42, as well as the body of each of the track segments 26 surrounding the slot 40. Therefore, in order to assure and define a secured, gripping attachment between each of the track segments 26 and the corresponding ones of peripheral flanges 16, the flange segment 17 is inserted into the interior of the elongated slot 40 such that the flange segment 19 of each of the peripheral flanges 16 protrudes outwardly from the opening 42. Each of the peripheral flanges 16 are thereby attached in secured gripping engagement and in somewhat surrounded or enclosed relation on the interior of the slot 40, while allowing a portion of each of the peripheral flanges 16 to extend outwardly through the opening 42 associated with each of the elongated slots 40. By virtue of this secured, gripping attachment, the use of a plurality of conventional fasteners or connectors, such as but not limited to rivets, bolts, furthermore screws, is thereby avoided and the chances of even partial separation or detachment of the track segments 26 from their fixedly secured, operative position about the peripheral portion is minimized. Furthermore, the securement is continuous along the entire length of the peripheral segments so as to achieve a uniform engagement throughout. It s noted that the slot 40 may extend through only one end of the track segments so as to permit the slided engagement between the track segment and the peripheral flange.

Another feature of the present invention as shown in FIGS. 6 through 9 and comprises the aforementioned corner assembly 22. In practice, a plurality of corner assemblies 22 are preferably incorporated within the pallet assembly 10 of the present invention, depended upon the overall configuration thereof. Each of such corner assemblies 22 includes a corner segment 46 which is dimensioned and configured to substantially fill the space between correspondingly positioned ends 18 of adjacently positioned ones of the peripheral flanges 16, as best shown in FIGS. 2 and 3. The inclusion of one or more corner assemblies 22 in the manner shown in FIG. 1 provides a substantially continuous, un-interrupted peripheral portion that eliminates the aforementioned spaces between the corresponding ends 18. More specifically, each of the corner assemblies 22 includes at least one but preferably two, outwardly extending connecting assemblies, generally indicated as 48. Each connecting assembly 48 preferably includes a plurality of connector members comprising a first connector member 50 and a second connector member 52. As best shown in FIGS. 6, 7, and 8, each of the connecting assemblies 48 extends outwardly from spaced apart ends 46' of the corner segment 46. In addition, the individual connector members 50 and 52 are preferably disposed in spaced apart relation to one another and extend outwardly from a common end 46' of the corner segment 46 in the same direction and in substantially parallel relation to one another. As is also apparent, the relative dimensions of the individual connector members 50 and 52 of each connecting assembly 48 differ both in transverse dimension and length. Also, the cross-sectional configuration of each of the connector members 50 and 52, as well as the dimensions thereof are specifically designed to be inserted respectively in an open end of the central channel 28 and an open end of the track 32, as seen in FIG. 9. Accordingly the cross-sectional configuration and overall dimension of the central channel 28 is such as to receive, by insertion, connecting member 50 and, in a cooperative fashion, an interior 34 of the track 32 is designed to receive, by insertion, the connector member 52. It should be apparent therefore that the mounting or securement of each of the corner assemblies 48 in aligned relation to corresponding base corners 20 is achieved by direct connection to adjacently positioned track segments 26, without the use of rivets or like conventional connectors. Of course, it is understood that one or more connector members could be integrated as part of a single or separate elements to correspond an opening into the hollow interior of the track segments. For example, separate channels and the like may be defined in the ends of the track segments for the express purpose of receiving one or more connector members of a variety of configurations. Also, a tight, press fit engagement could be achieved with or without a locking structure, such as a raised button disposed thereon.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An aircraft pallet assembly structured to support and secure a load thereon under a load retaining structure, said aircraft pallet assembly comprising:

a) a base including a peripheral portion disposed in substantially surrounding relation to said base b) said peripheral portion including at least one peripheral flange extending outwardly from said base;

c) said peripheral flange including an inner flange segment and an outer flange segment disposed in non-coplanar relation to one another, d) a track assembly, said track assembly including at least one track segment defined therein;

e) said track segment including an elongated slot recessed therein;

f) said elongate slot including an elongate opening defined along a length thereof;

g) said elongate slot structured to receive said outer flange segment of said peripheral flange therein;

h) said elongate opening being sized and configured to permit said peripheral flange to protrude therethrough with said outer flange segment securely disposed in said elongated slot;

i) said elongated slot and said elongate opening being further sized and configured to restrict removal of said outer flange segment from said elongate slot through said elongated opening, thereby effectively securing said peripheral flange with said track segment; and j) said track segment structured to be removably secured to the load retaining structure so as to retain the load on said base.

2. An aircraft pallet assembly as recited in claim 1 wherein said track segment is structured to engage said peripheral flange exterior of said elongated slot so as to further maintain said secure engagement of said outer flange member in said elongated slot and restrict removal of said outer flange member through said elongate opening.

3. An aircraft pallet assembly as recited in claim 1 wherein said elongated slot is recessed from a bottom of said track segment, said elongate opening structured to provide generally vertical access into said elongated slot so as to accommodate said non-coplanar relation between said outer flange member within said elongate slot and said inner flange member outside of said elongate slot.

4. An aircraft pallet assembly as recited in claim 1 wherein said elongate opening is disposed to provide generally vertical access to said elongated slot so as to restrict lateral removal of said outer flange member from said elongate slot and maintain said secure engagement between said peripheral flange and said track segment.

5. An aircraft pallet assembly as recited in claim 1 wherein said elongated slot includes at least one open end structured to provide slided, longitudinal introduction of said outer flange segment into said elongate slot with a remainder of said peripheral flange protruding through said elongate opening.

* * * * *